US008285532B2

(12) United States Patent
Zangl et al.

(10) Patent No.: US 8,285,532 B2
(45) Date of Patent: Oct. 9, 2012

(54) PROVIDING A SIMPLIFIED SUBTERRANEAN MODEL

(75) Inventors: Georg Zangl, Laxenburg (AT); Radek Pecher, Witney (GB); Anthony J. Fitzpatrick, Oxford (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 530 days.

(21) Appl. No.: 12/399,285

(22) Filed: Mar. 6, 2009

(65) Prior Publication Data

US 2009/0234625 A1 Sep. 17, 2009

Related U.S. Application Data

(60) Provisional application No. 61/036,872, filed on Mar. 14, 2008.

(51) Int. Cl.
*G06G 7/48* (2006.01)

(52) U.S. Cl. ..... 703/10; 703/6

(58) Field of Classification Search ..... 703/6, 10
See application file for complete search history.

(56) References Cited

U.S. PATENT DOCUMENTS

| | | | | |
|---|---|---|---|---|
| 5,139,094 | A | 8/1992 | Prevedel et al. | |
| 5,680,906 | A | 10/1997 | Andrieux et al. | |
| 5,899,958 | A | 5/1999 | Dowell et al. | |
| 5,992,519 | A | 11/1999 | Ramakrishnan et al. | |
| 6,106,561 | A | 8/2000 | Farmer | |
| 6,266,619 | B1 | 7/2001 | Thomas et al. | |
| 6,313,837 | B1 | 11/2001 | Assa et al. | |
| 6,801,197 | B2 | 10/2004 | Sanstrom | |
| 6,980,940 | B1 | 12/2005 | Gurpinar et al. | |
| 7,003,439 | B2 | 2/2006 | Aldred et al. | |
| 7,079,952 | B2 | 7/2006 | Thomas et al. | |
| 7,254,091 | B1 * | 8/2007 | Gunning et al. | 367/73 |
| 7,725,302 | B2 * | 5/2010 | Ayan et al. | 703/10 |
| 2003/0132934 | A1 | 7/2003 | Fremming | |
| 2003/0216897 | A1 | 11/2003 | Endres et al. | |
| 2004/0220846 | A1 | 11/2004 | Cullick | |
| 2005/0149307 | A1 | 7/2005 | Gurpinar et al. | |
| 2005/0209836 | A1 | 9/2005 | Klumpen et al. | |
| 2005/0211468 | A1 | 9/2005 | Veeningen et al. | |
| 2005/0228905 | A1 | 10/2005 | Veeningen et al. | |

(Continued)

FOREIGN PATENT DOCUMENTS

EP 1242881 B1 11/2007

(Continued)

OTHER PUBLICATIONS

Kashib et al., "A probabilistic approach to integrating dynamic data in reservoir models", Journal of Petroleum Science and Engineering, vol. 50, Issues 3-4, Mar. 2006, pp. 241-257.*

(Continued)

*Primary Examiner* — Kamini S Shah
*Assistant Examiner* — Herng-Der Day

(57) ABSTRACT

To provide a simplified subterranean model of a subterranean structure, a first grid size for the simplified subterranean model is selected, where the first grid size is coarser than a second grid size associated with a detailed subterranean model. The simplified subterranean model is populated with subterranean properties according to the selected first grid size, where multiple realizations of the simplified subterranean model are provided for different sets of values of the subterranean properties. The realizations of the simplified subterranean model are ranked based on comparing outputs of simulations of the realizations with measured data associated with the subterranean structure.

17 Claims, 5 Drawing Sheets

U.S. PATENT DOCUMENTS

| | | | | |
|---|---|---|---|---|
| 2005/0236184 | A1 | 10/2005 | Veeningen et al. | |
| 2006/0197759 | A1 | 9/2006 | Fremming | |
| 2007/0112547 | A1 | 5/2007 | Ghorayeb et al. | |
| 2008/0167849 | A1 * | 7/2008 | Hales et al. | 703/10 |
| 2008/0255816 | A1 | 10/2008 | Neville | |

FOREIGN PATENT DOCUMENTS

| | | | |
|---|---|---|---|
| GB | 2322702 | | 9/1998 |
| GB | 2392931 | A | 3/2004 |
| GB | 2411669 | | 9/2005 |
| GB | 2413200 | | 10/2005 |
| WO | 9964896 | | 12/1999 |
| WO | 2004049216 | | 6/2004 |
| WO | 2005120195 | | 12/2005 |

OTHER PUBLICATIONS

Giles et al.; "An Introduction to the Adjoint Approach to Design", Flow, Turbulence and Combustion 65: 393-415, 2000.

Wikipedia; "Geostatics"; Jan. 2009; Retrieved on-line from "http://en.wikipedia.org/wiki/Geostatics".

Schlumberger; "Eclipse SimOpt fast and interactive history matching" Simulation; 2003 Schumberger Information Solutions.

Examination Report of Canadian Application No. 2,657,715 dated Sep. 7, 2011.

* cited by examiner

PROVIDING A SIMPLIFIED SUBTERRANEAN MODEL

CROSS REFERENCE TO RELATED APPLICATION

This claims the benefit under 35 U.S.C. §119(e) of U.S. Provisional Application Ser. No. 61/036,872, entitled "System and Method for Performing Oilfield Operations Using Reservoir Modeling," filed Mar. 14, 2008, which is hereby incorporated by reference.

BACKGROUND

A model can be generated to represent a subterranean structure, where the subterranean structure can be a reservoir that contains fluids such as hydrocarbons, fresh water, or injected gases. A model of a reservoir ("reservoir model") can be used to perform simulations to assist in better understanding characteristics of the reservoir. For example, well operators can use results of simulations based on the reservoir model to assist in improving production of fluids from the reservoir. The reservoir model can be used as part of a production optimization workflow that is designed to improve production performance.

Conventional reservoir models are typically "detailed" or "fine" reservoir models. A detailed or fine reservoir model includes a relatively fine grid of cells that represent corresponding volumes of the subterranean structure. Each of the cells of the reservoir model is associated with various properties that define various characteristics of the formation structures in the volume.

The number of cells selected for a detailed reservoir model typically is based on the available computational power provided by a computer system used for performing a simulation using the detailed reservoir model. For improved accuracy, the granularity of the grid of cells that make up the detailed reservoir model is selected to be as fine as practical. The operator typically attempts to discretize the model to as fine a grid as possible such that a simulation using the detailed model can complete its run overnight (execution time of greater than eight hours, for example).

Although a detailed reservoir model can provide relatively accurate results, use of a detailed reservoir model may not be practical or efficient in certain scenarios due to the relatively long computation times. Also, development of detailed reservoir models may not be cost effective, particularly for reservoirs that are considered marginal reservoirs (those reservoirs that are not expected to produce a large volume of fluids, that are relatively small, or that are approaching end of life). Moreover, using a detailed reservoir model in a production optimization workflow can slow down execution of the overall workflow, since the simulation of the detailed reservoir model can take a rather long time to complete. A user of the production optimization workflow may desire to obtain answers quickly when performing an optimization procedure with respect to a field of one or more production wells.

SUMMARY

In general, according to an embodiment, a simplified subterranean model of a subterranean structure is provided, in which a coarse grid size is selected for the simplified subterranean model, where the coarse grid size is coarser than a grid size associated with a detailed subterranean model. The simplified subterranean model is populated with subterranean properties according to the selected grid size, where multiple realizations of the simplified subterranean model are provided for different sets of values of the subterranean properties. The realizations of the simplified subterranean model are ranked based on comparing outputs of simulations of the realizations against measured data associated with the subterranean structure.

Other or alternative features will become apparent from the following description, from the drawings, and from the claims.

DETAILED DESCRIPTION

In the following description, numerous details are set forth to provide an understanding of some embodiments of providing a simplified reservoir model. However, it will be understood by those skilled in the art that embodiments of providing a simplified reservoir model may be practiced without these details and that numerous variations or modifications from the described embodiments are possible.

Figure 1:
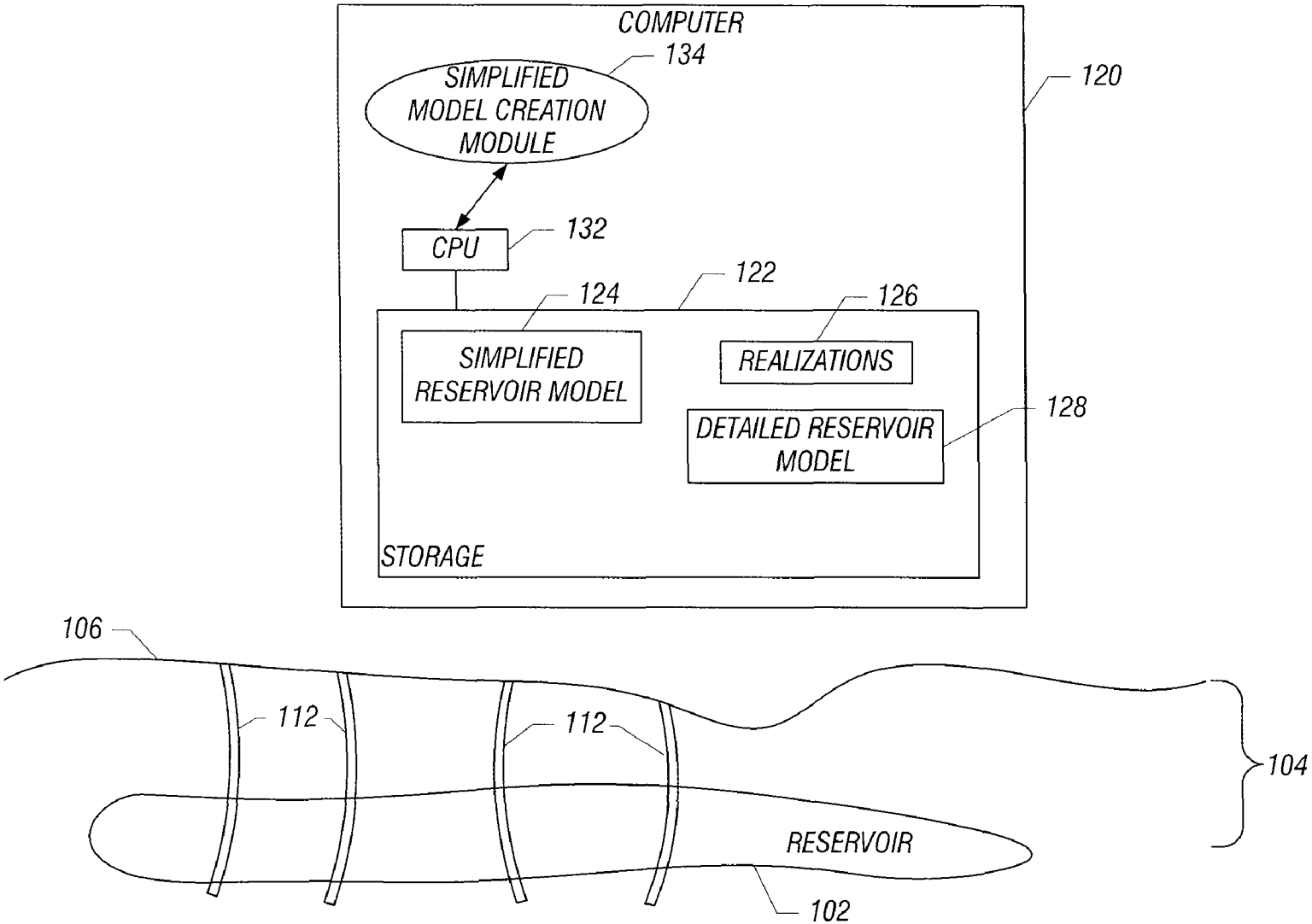
FIG. 1 is a schematic diagram of an exemplary arrangement in which an embodiment of producing a simplified subterranean model can be incorporated.

FIG. 1 illustrates an exemplary arrangement in which some embodiments of producing a simplified reservoir model can be incorporated. A reservoir 102 is depicted in a subsurface 104 below a ground surface 106. Although just one reservoir is depicted, it is noted that multiple reservoirs can be present. FIG. 1 also shows various wells 112 drilled into the subsurface 104, where the wells intersect the reservoir 102. The wells 112 can be used to produce fluids from the reservoir 102 towards the ground surface 106 and/or to inject fluids for storage or pressure support in the reservoir 102.

The arrangement shown in FIG. 1 is an example of a land-based arrangement in which wells 112 are drilled into the subsurface from a land ground surface 106. Alternatively, the wells 112 can be drilled into the subsurface 104 in a marine environment, where the wells 112 extend from a water bottom surface (such as a seabed). Techniques according to some embodiments of producing a simplified subterranean model can be applied for either a land-based environment or marine environment.

In accordance with some embodiments, a simplified subterranean model of a subterranean structure located in the subsurface 104 can be created by using a computer 120 that has a simplified model creation module 134, which can be a software module executable on one or more central processing units (CPUs) 132.

In some embodiments, the simplified subterranean model is a reservoir model that represents the reservoir 102 shown in FIG. 1. Alternatively, the simplified subterranean structure model can represent another type of subterranean structure in the subsurface 104. In the ensuing discussion, reference is made to reservoir models; however, it is noted that techniques according to some embodiments are applicable to other types of subterranean structures.

A "simplified" reservoir model refers to a model of the reservoir 102 that has a coarser grid of cells than a detailed or fine reservoir model that represents the reservoir. A cell in the model represents a corresponding volume within the reservoir, where the cell is associated with various characteristics of the formation structures in the corresponding volume. Example characteristics of formation structures include one or more of the following: rock properties such as permeability, porosity, compressibility, saturation-dependent relative-permeability and capillary-pressure curves, transmissibilities across geological faults and fractures, and others.

The number of cells contained within the reservoir model is dependent upon the grid size of the model—a coarser grid corresponds to a smaller number of cells, while a finer grid corresponds to a larger number of cells. A "detailed" or "fine" reservoir model is a reservoir model that has as many cells as permitted by the available computational resources. Typically, a detailed or fine reservoir model is discretized into a grid of such size that allows one complete simulation to be run overnight. An operator can launch a simulation run using the detailed reservoir model before leaving work and the simulation results would be ready by the next morning.

A simplified or coarse reservoir model, on the other hand, is a reservoir model that has a significantly smaller number of cells compared to the detailed reservoir model. In some implementations, the simplified reservoir model is able to run in the order of minutes or even seconds, while still providing desirable details that a well operator wishes to be considered in the simulation. In other embodiments, the simplified model's grid size is chosen so that the simulation completes within an hour.

In many cases, a detailed reservoir model can include 500,000 cells to 10 million cells. On the other hand, a simplified reservoir model can include 100,000 cells or less. Although exemplary values are used above, it is noted that in alternative implementations, a simplified reservoir model can have a different grid size. More generally, the grid size selected for a simplified reservoir model is coarser than the grid size of the detailed reservoir model (in other words, the number of cells in the simplified reservoir model is smaller than the number of cells in the detailed reservoir model). In some implementations, the grid size of the simplified reservoir model can be five or more times larger than the grid size of the detailed reservoir model.

The grid size of a simplified reservoir model is usually selected by the user. For example, the user can be presented with a graphical user interface (GUI) screen that has input fields for specifying the grid size of the simplified reservoir model. Alternatively, the grid size can be entered in a different manner, such as in the form of an input file that contains a field corresponding to the grid size. As yet another alternative, the grid size of the simplified reservoir model can be also selected automatically by a control system, such as software for designing workflows in order to optimize production of fluids from a reservoir through one or more wells.

The simplified reservoir model generated according to some embodiments is a history-matched simplified reservoir model that is created based on matching its simulation results with historical data collected for a given reservoir. Historical data includes data collected from wells, such as information relating to well trajectory, well logs (logs of various parameters such as temperature, pressure, resistivity, and so forth collected by logging tools lowered into the wells), information regarding core samples, information about completion equipment, information regarding production or injection of fluids, and so forth. The historical data also includes information regarding the structure and characteristics of the reservoir, such as structural information of the reservoir, information about faults in the reservoir, information about fractures in the reservoir, three-dimensional (3D) porosity distribution, and so forth. The information about the structure and characteristics of the reservoir can be derived based on survey data collected by survey equipment, such as seismic survey equipment or electromagnetic (EM) survey equipment.

In some embodiments, multiple realizations of the simplified reservoir model are generated. A realization of the simplified reservoir model refers to an instance of the simplified reservoir model that is associated with a set of values assigned to various properties (e.g., rock properties) of the simplified reservoir model. Different instances are associated with different sets of values of the reservoir model.

Since data of different origin and kind (each associated with some uncertainty) are used in creating the base simplified reservoir model, such uncertainty results in several possible interpretations. To address this uncertainty, a stochastic process is used to address the possibility of multiple interpretations. The stochastic process produces multiple realizations of the base simplified reservoir model, which can be evaluated to identify the best realization according to some predefined metric.

The realizations are ranked according to a history match quality. Each realization is simulated to produce an output that is then compared to the historical (observed) data. The history match quality of the simulated data is indicated by a metric that indicates how close the simulated data is to the historical data. In some embodiments, the metric can be a root-mean-square (RMS) error that is computed from the simulated data and observed data. The one or more highest ranked realizations of the simplified reservoir model are then selected for further use.

As depicted in FIG. 1, the computer 120 has a storage 122 in which various data structures can be stored. As examples, the data structures that can be stored in the storage 122 include a simplified reservoir model 124, realizations 126 of the simplified reservoir model, and possibly a detailed reservoir model 128.

Figure 2:
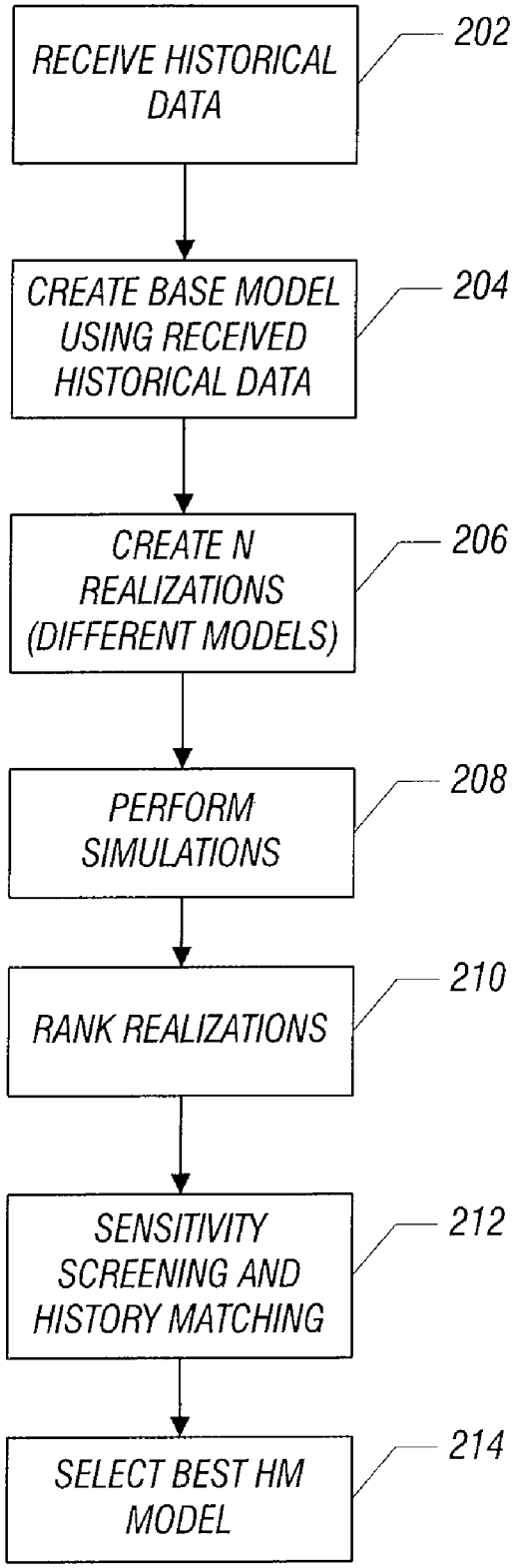
FIG. 2 is a flow diagram of general tasks performed according to an embodiment of providing a simplified reservoir model.

FIG. 2 is a flow diagram of a general process of creating a simplified reservoir model, according to an embodiment. Some or all of the tasks depicted in FIG. 2 can be performed by the simplified model creation module 134 shown in FIG. 1. Historical (observed or measured) data is received (at 202), where the historical data includes well-related data such as information regarding trajectory of one or more wells, well logs, information collected from core samples, information related to completion equipment installed in wells, historical production and/or injection data, and other information. The received historical data can also include data regarding the reservoir, such as structural information of the reservoir, information about faults or fractures within the reservoir, a three-dimensional porosity distribution, and so forth.

Next, a base simplified reservoir model is created (at 204) using the received historical data. The received historical data can be used to determine the structure of the reservoir, such that a user can make a selection regarding a coarse grid size for the simplified reservoir model that is to be created. For example, the historical data can assist the user in determining boundaries of the reservoir, such that the coarse grid boundaries coincide with the boundaries of the reservoir. The base simplified reservoir model has a grid of cells representing volumes of the reservoir, and each of the cells is associated with properties that define formation structures in the respective cell.

In some cases, a detailed reservoir model that was previously created may also be available. If so, the information from the detailed reservoir model can be imported to assist in creating the base simplified reservoir model that has a coarser grid than a grid of the detailed reservoir model.

Next, N realizations of the reservoir model are created (206) from the base simplified reservoir model, where N is a configurable number greater than or equal to one (which can be specified by user or by some other technique). Each realization is populated with its own set of values assigned to the properties that define the base simplified reservoir model of the selected grid size.

Simulations are then performed (at 208) using the N realizations. The simulated data from the N simulations are compared to observed historical data, and based on the comparison, metrics are derived indicating how closely matched the corresponding simulated data is to the observed data. The N realizations are ranked (at 210) according to the metrics.

Next, sensitivity screening and history matching are performed (at 212). Sensitivity screening involves an analysis in which values of reservoir properties are varied in each realization of the simplified reservoir model in order to determine sensitivity of the simulated data to variations in the reservoir property values. The output of the sensitivity screening allows for refined history matching.

Next, the best history-matched simplified reservoir model realization is selected (at 214). The selected simplified reservoir model can then be used in a workflow, such as a production optimization workflow.

Figure 3:
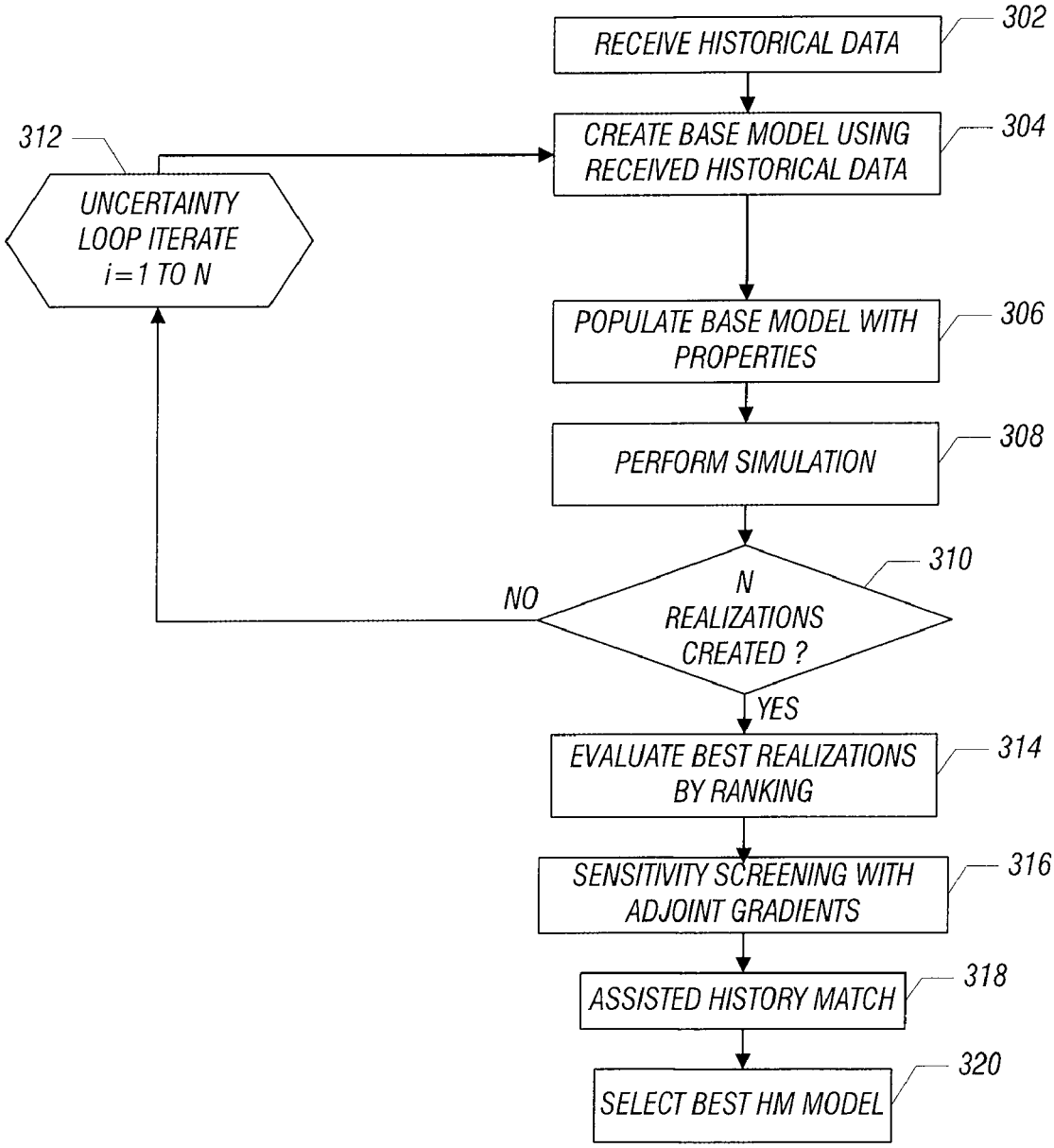
FIG. 3 is a flow diagram of a more detailed process according to an embodiment of providing a simplified reservoir model.

FIG. 3 shows a more expanded view of the process of creating a simplified reservoir model according to some embodiments. Historical data is received (at 302), and a base reservoir model is created (at 304) using the received historical data (or alternatively using information from a detailed reservoir model if available). The created base reservoir model has a coarse grid. Tasks 302 and 304 of FIG. 3 are similar to the corresponding tasks 202 and 204 in FIG. 2.

In FIG. 3, the creation of N realizations is shown as being performed in an iterative loop. After creation of the base reservoir model, the process then populates (at 306) the reservoir model with values of subterranean properties in corresponding cells of the model. The subterranean property values are selected using an algorithm that allows for the generation of different sets of property values for different realizations. For example, a stochastic algorithm can employ a seed for initializing a random number generator from which the property values are derived in order to populate the base simplified reservoir model and the realization in each iteration. The realization is referred to as the ith realization, where the variable i is incremented with each iteration.

Next, a simulation of the ith realization is performed (at 308). The output of the realization (simulated data) is stored. Next, it is determined (at 310) whether all N realizations have been created and run. If not, then an uncertainty loop (312) is performed—the uncertainty loop is performed N times since there is uncertainty in the input data and/or there is other uncertainty.

The uncertainty loop causes tasks 304, 306, 308, and 310 to be repeated for creating the ith realization.

When all N realizations have been created, then the realizations are evaluated (at 314) based on history matching the simulated data produced by simulations using the N realizations with historical observed data. The evaluation outputs history match metrics that allow ranking of the N realizations.

Next, sensitivity screening is performed (at 316), such as by using an adjoint gradients technique. The sensitivity screening involves sensitivity analysis that identifies the most sensitive parameters. Adjoint gradients are calculated which are used to identify the most sensitive parameters. Various exemplary adjoint gradient techniques are described in Michael B. Giles et al., "An Introduction to the Adjoint Approach to Design," Flow, Turbulence and Combustion, pp. 393-415 (2000).

Next, assisted history matching is performed (at 318) for the at least some of the N realizations (e.g., a certain number of the N best realizations). The assisted history matching is a forward gradient history match that uses the identified most sensitive parameters output by the sensitivity analysis. For fine tuning, a forward gradient technique (e.g., by using the SimOpt™ software from Schlumberger) can be used to evaluate property sensitivities combined with a regression algorithm to minimize a given objective function. With a limited amount of input, the gradient technique is able to find the best history match for each of the highest ranked realizations. The gradient technique calculates gradients in a simulation run for one or more parameters that are defined by a user as being uncertain. The gradient technique allows user-controlled or automated optimization (regression runs) using gradient information to progressively adjust the selected parameters to improve the history matching.

The gradient technique performs repeated runs, changing parameter values and progressively adjusting the respective realization of the simplified reservoir model until predetermined criteria have been met. Each adjusted realization of the simplified reservoir model is saved.

Next, after the assisted history matching, the best history-matched realization of the simplified reservoir model is selected (at 320).

Figure 4:
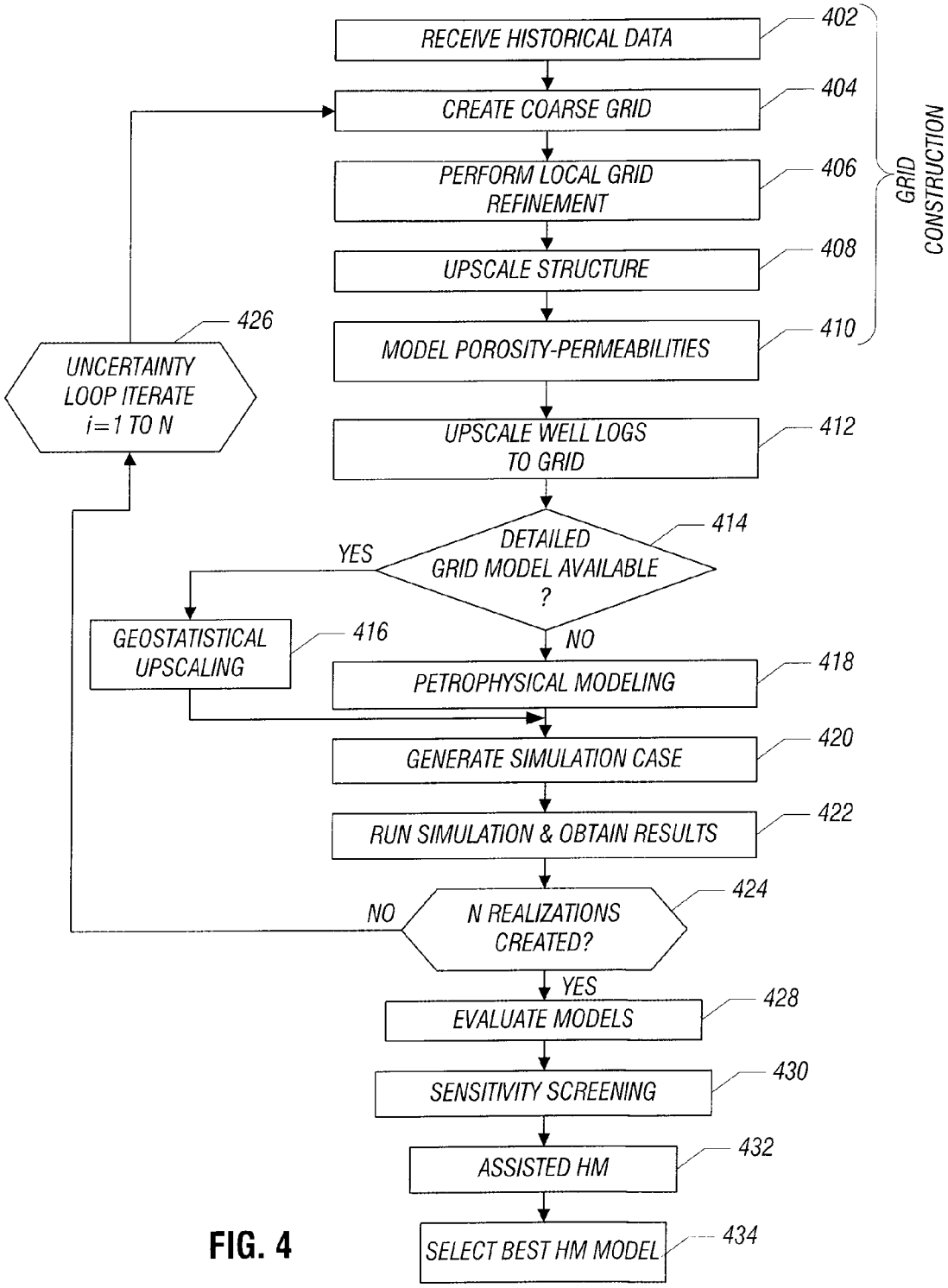
FIG. 4 is a flow diagram that illustrates additional tasks involved in producing a simplified reservoir model, according to an embodiment.

FIG. 4 is a flow diagram of a more detailed process for creating a simplified reservoir model. Historical data is received (at 402). Next, using information of the historical data (or information from a detailed reservoir model if available), a coarse grid is created (at 404), where the grid size is selected in response to user input or in response to selection by an automated control system. The coarse grid can include boundaries of the reservoir, if such boundaries are known. However, if boundaries are unknown, then the grid of cells can be simply shaped, such as with linear boundaries.

Local grid refinement is then performed (at 406), such as to make the grid size finer in regions around relevant wells that intersect the reservoir being studied. Wells can be arbitrarily shaped, as long as their trajectory is known. Also, multi-segmented wells (such as a well with multiple zones or a multilateral well) can also be incorporated.

Next, the process upscales (at 408) the structure of the representation of the reservoir. For example, a vertical coarsening of the structure into simulation layers can be performed. Vertical coarsening refers to taking two or more actual layers of the reservoir and combining (or lumping) the layers into a single simulation layer. The upscaling of the reservoir structure results in fewer layers that have to be studied, which in turn allows use of a coarser grid size without losing too much accuracy.

Next, a porosity-permeability relationship of the reservoir is modeled (at 410). Also, lithofacies (rock types) are also defined for the reservoir. Such information can be used later in simulations of realizations of the simplified reservoir model.

Tasks 402, 404, 406, 408, and 410 are part of a grid construction process. After the grid construction process, the base simplified reservoir model is populated with reservoir properties to produce a realization. Note that multiple realizations are created in multiple iterative loops of the process of FIG. 4 (similar to the process of FIG. 3).

Imported well logs are upscaled (at 412) to the coarse grid dimensions, including the finer dimensions generated using the local grid refinement (of task 406) before they are used to populate the base simplified reservoir model. Once the well logs have been upscaled, a determination is made regarding which technique to use to populate formation property values into the base simplified reservoir model. The selection of the technique to use is based on determining (at 414) whether a detailed reservoir model is available.

If the detailed reservoir model is available, then a geostatistical upscaling method is applied (at 416) to populate the base simplified reservoir model with each formation property values. The geostatistical method is an interpolation technique to populate the model based on sparse input data. In regions of the reservoir far away from the wells that intersect the reservoir, there may be sparse data that describes such regions. Interpolation is then used to generate data for regions in which there are gaps in the input data. When the detailed reservoir model is available, information available in the detailed reservoir model can be leveraged to obtain the realization of the base simplified reservoir model.

If the detailed reservoir model is determined (at 414) to be not available, then the process performs petrophysical modeling (at 418). Petrophysical modeling can be based on a deterministic modeling technique, in which well logs are scaled up to the resolution of the cells in the grid, and the values of properties for each cell can be interpolated between the wells. Alternatively, petrophysical modeling can be based on a sequential Gaussian simulation technique.

A simulation case is then generated (at 420), where the simulation case contains one or more input data files that specifies the conditions for the simulation. The simulation of the realization is then run (at 422), and the simulated data is obtained and saved.

Next, it is determined (at 424) if N realizations have been generated. If not, an uncertainty loop (426) is performed, in which tasks 404, 406, 408, 410, 412, 414, 416, 418, 420, and 422 are repeated to obtain the ith realization.

Once N realizations are created, the realizations are evaluated (at 428) and ranked. Sensitivity screening is then performed (at 430) using adjoint gradients, as described above. Next, assisted history matching is performed (at 432), and the best history matched model is selected (at 434).

Typical full field reservoir simulation models tend to be too slow and/or cumbersome for use in production workfloes. In addition, economical readons may prevent numeric modeling of small, marginal or mature fields where only limited amount of data is available. As an example, a method can enable an engineer to setup and history match a simplified reservoir model (SRM) in an extremely short time with adequate accuracy.

As an example, reservoir simulations may be performed using multiple model realizations to generate multiple simulation results as well as sensitivity information regarding variation of simulation output verses variation in an uncertainty parameter. The sensitivity information may include ranking of sensitivity of particular simulation output from among the one or more uncertainty parameters. The sensitivity information may also include indications of reservoir regions where the simulation output varies most with respect to variation of a particular uncertainty parameter.

As an example, multiple simulation results may be compared to history data (e.g., production data such as oil rate, water rate, etc.) to determine a ranking based on a pre-determined measure of the deviation. One or more (e.g., five) model realization candidates may be selected based on the ranking for further fine tuning.

As an example, a method can include generating reservoir model candidates based on fast turn-around workflow steps, fine tuning such reservoir model candidates based on information obtained and/or accumulated in previous workflow steps, and generating a best history matched reservoir model based on selective fine tuning.

Figure 5:
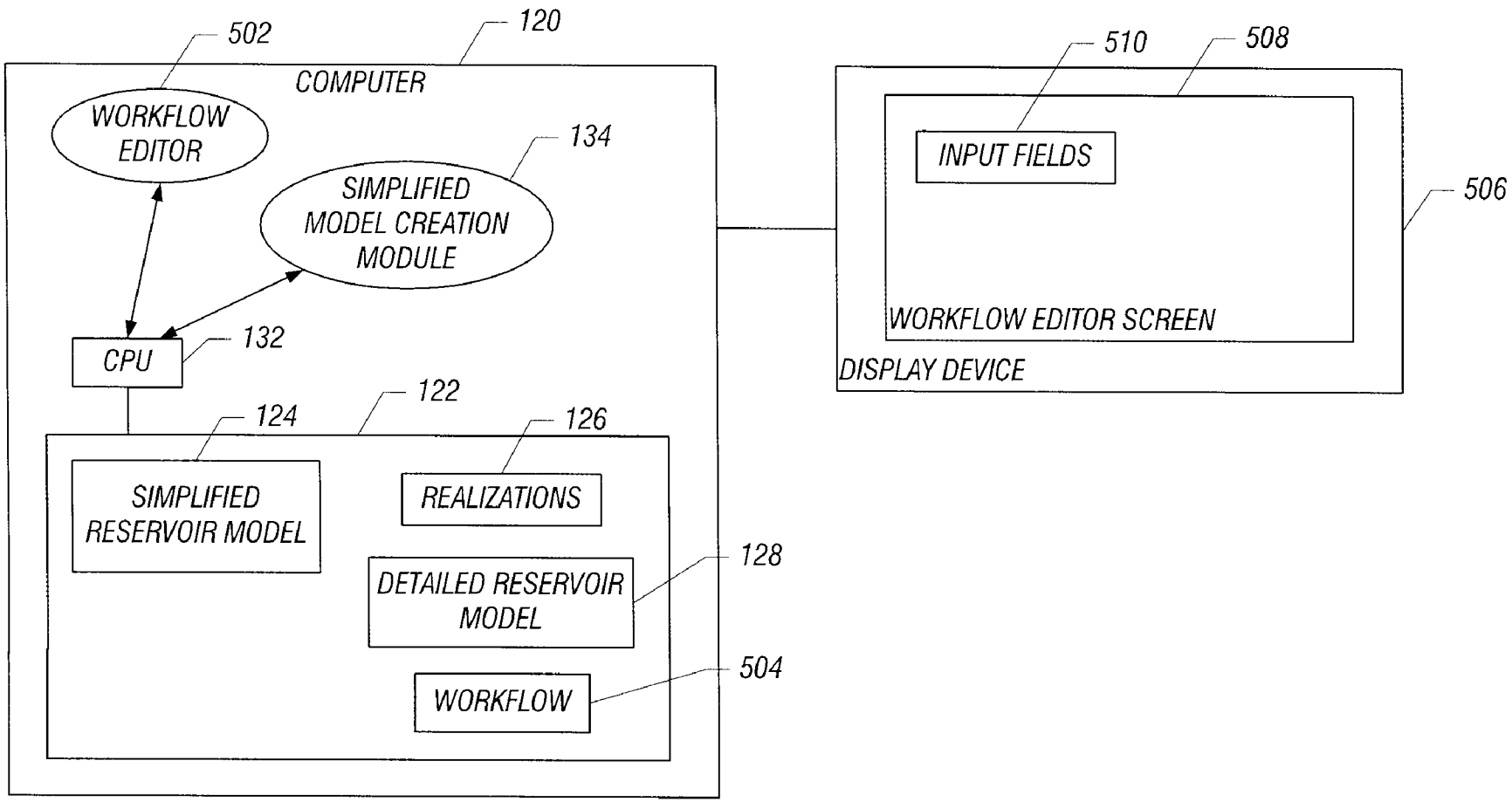
FIG. 5 is a block diagram of a computer that includes components according to another embodiment.

FIG. 5 shows the computer 120 having further components, including the simplified model creation module 134 and a workflow editor 502 that are both executable on the CPU(s) 132. The workflow editor 502 presents a workflow editor screen 508 in a display device 506 to allow a user to create or modify a workflow relating to operations associated with a reservoir, such as production operations. A workflow 504 (stored in the storage 122) generated by the workflow editor 502 in response to user input can be a workflow to optimize production of the reservoir. For example, the workflow editor can specify tasks (including well monitoring tasks, well equipment adjustment tasks, etc.) to be performed. A reservoir model can be used in the workflow 504 to provide computed data that can assist a well operator in making decisions that would enhance production of the reservoir.

By using the simplified reservoir model instead of a detailed reservoir model, simulations involving the simplified reservoir model can be completed more quickly, so that results can be returned to the operator in a timely manner.

The workflow editor screen 508 includes input fields 510 that allow a user to adjust various settings associated with the workflow 504. Some of these settings relate to the simplified reservoir model, including the coarse grid size selected.

Instructions of software described above (including the simplified model creation module 134 of FIGS. 1 and 5 and the workflow editor 502 of FIG. 5) are loaded for execution on a processor (such as one or more CPUs 132 in FIG. 1 or 5). The processor includes microprocessors, microcontrollers, processor modules or subsystems (including one or more microprocessors or microcontrollers), or other control or computing devices. A "processor" can refer to a single component or to plural components (e.g., one CPU or multiple CPUs).

Data and instructions (of the software) are stored in respective storage devices, which are implemented as one or more computer-readable or computer-usable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

In addition, the various methods described above can be performed by hardware, software, firmware, or any combination of the above.

While embodiments of providing a simplified reservoir model has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method executed by a computer, the method comprising:

selecting a production workflow for a subterranean structure that comprises wells wherein the production workflow depends on availability of simulation data;

responsive to selecting the production workflow, building a simplified simulation model for the subterranean structure by selecting a grid size for a grid of the simplified simulation model, the grid size greater than a grid size for a grid of an existing detailed simulation model for the subterranean structure, populating the grid of the simplified simulation model using data wherein the data comprises data from the existing detailed simulation model, generating candidate simplified simulation models using a stochastic process wherein each of the candidate simplified simulation models comprises the grid size for the grid of the simplified simulation model, performing simulation runs using each of the candidate simplified simulation models to generate candidate simulation data, after performing the simulation runs, comparing the generated candidate simulation data to measured data for the subterranean structure to rank the candidate simplified simulation models with respect to accuracy, performing a sensitivity analysis to fine tune at least a top ranked candidate simplified simulation model of the candidate simplified simulation models, and selecting a fine tuned candidate simplified simulation model of the candidate simplified simulation models; and performing one or more runs of the selected, fine tuned candidate simplified simulation model to generate the simulation data for the production workflow.

2. The method of claim 1 wherein the sensitivity analysis comprises analyzing the candidate simulation data generated by performing the simulation runs using each of the candidate simplified simulation models.

3. The method of claim 1 wherein the populating the grid comprises using data from the existing detailed simulation model to populate a region of the grid of the simplified simulation model lacking measured data.

4. The method of claim 1 wherein the stochastic process generates each of the candidate simplified simulation models populated with a different set of data.

5. The method of claim 4 wherein the different sets of data differ with respect to data for one or more uncertainty parameters.

6. The method of claim 1 wherein the stochastic process generates candidate simplified simulation models based on selecting one or more uncertainty parameters.

7. The method of claim 6 wherein performing the sensitivity analysis uses the generated candidate simulation data from performing the simulation runs using each of the candidate simplified simulation models and wherein performing the sensitivity analysis comprises analyzing the generated candidate simulation data, from performing the simulation runs using each of the candidate simplified simulation models, with respect to at least one of the one or more uncertainty parameters.

8. The method of claim 1 wherein the comparing comprises history matching.

9. The method of claim 1 further comprising assisted history matching based at least in part on the sensitivity analysis.

10. The method of claim 1 further comprising performing local grid refinement in a region of the grid of the simplified simulation model, wherein the region surrounds one of the wells.

11. The method of claim 1 wherein the detailed simulation model comprises a number of grid cells, wherein the simplified simulation model comprises a number of grid cells, and wherein the number of grid cells of the simplified simulation model is less than 20% of the number of grid cells of the detailed simulation model.

12. The method of claim 1 wherein the simplified simulation model comprises a three-dimensional spatial model for simulating behavior of the subterranean structure with respect to time.

13. The method of claim 1, further comprising:

providing a user interface, wherein selecting the grid size is in response to user input in the user interface.

14. The method of claim 13, wherein providing the user interface comprises providing the user interface as part of a workflow editor to enable user editing of the selected production workflow to perform building of the simplified simulation model.

15. One or more computer-readable non-transitory storage media comprising computer-executable instructions to instruct a computer to:

build a simplified simulation model for a subterranean structure responsive to selection of a production workflow that depends on availability of simulation data, wherein the instructions to instruct a computer to build the simplified simulation model comprise instructions to:

select a grid size for a grid of the simplified simulation model, the grid size greater than a grid size for a grid of an existing detailed simulation model for the subterranean structure, populate the grid of the simplified simulation model using data wherein the data comprises data from the existing detailed simulation model, generate candidate simplified simulation models using a stochastic process wherein each of the candidate simplified simulation models comprises the grid size for the grid of the simplified simulation model, perform simulation runs using each of the candidate simplified simulation models to generate candidate simulation data, after performance of the simulation runs, compare the generated candidate simulation data to measured data for the subterranean structure to rank the candidate simplified simulation models with respect to accuracy, perform a sensitivity analysis to fine tune at least a top ranked candidate simplified simulation model of the candidate simplified simulation models, and select a fine tuned candidate simplified simulation model of the candidate simplified simulation models to generate the simulation data for the production workflow.

16. The one or more computer-readable non-transitory storage media of claim 15 wherein the instructions for the stochastic process to generate candidate simplified simulation models comprise instructions based on selection of one or more uncertainty parameters.

17. The one or more computer-readable non-transitory storage media of claim 16 wherein the instructions to perform the sensitivity analysis comprise instructions to use the generated candidate simulation data from the simulation runs using each of the candidate simplified simulation models and to analyze the generated candidate simulation data, from the simulation runs using each of the candidate simplified simulation models, with respect to at least one of the one or more uncertainty parameters.

* * * * *